United States Patent [19]

Walk et al.

[11] Patent Number: 4,793,028

[45] Date of Patent: Dec. 27, 1988

[54] FIBER-REMOVING ROLL FOR A BALE OPENER

[75] Inventors: Johann Walk, Eichstaett; Kurt Kriechbaum, Ingolstadt, both of Fed. Rep. of Germany

[73] Assignee: Schubert & Salzer, Ingolstadt, Fed. Rep. of Germany

[21] Appl. No.: 120,113

[22] Filed: Nov. 2, 1987

[30] Foreign Application Priority Data

Nov. 4, 1986 [DE] Fed. Rep. of Germany ..... 3637579

[51] Int. Cl.[4] ..... D01G 7/04; D01G 7/06

[52] U.S. Cl. ..... 19/80 R; 19/81

[58] Field of Search ..... 19/80 R, 81, 85, 113, 19/114; 29/110, 121.1

[56] References Cited

U.S. PATENT DOCUMENTS

| | | | |
|---|---|---|---|
| 4,394,789 | 7/1983 | Egerer | 19/114 X |
| 4,510,646 | 4/1985 | Locatelli et al. | 19/80 R |
| 4,662,031 | 5/1987 | Feiks et al. | 19/80 R |
| 4,716,629 | 6/1988 | Iwata et al. | 19/114 |

*Primary Examiner*—Louis K. Rimrodt

*Attorney, Agent, or Firm*—Dority & Manning

[57] ABSTRACT

In a fiber removing roll 1 for a bale opener, the teeth 2 are removably attached on the circumference of the roll. They are provided with a contact surface 21 adapted to the circumferential contour of the fiber-removing roll and are held on the contour by screws screwed into pegs 4. The teeth are thus attached securely and can be replaced easily. In order to provide the teeth with a secure hold, independently of manufacturing tolerances, the contact surface is reduced to two contact shoulders 22, 23 spaced at a distance from each other.

10 Claims, 1 Drawing Sheet

FIBER-REMOVING ROLL FOR A BALE OPENER

BACKGROUND OF THE INVENTION

The instant invention relates to a fiber-removing roll for a bale opener, on the circumference of which teeth are removably installed.

In a known device, threads into which teeth are screwed are cut into the mantle of the fiber-removing roll (German published patent application no. 3,210,602). The teeth are made in the form of double teeth. Aside from the fact that the cutting of threads into the mantle surface is expensive, the wall of the roll must be appropriately thick to avoid the teeth from being pulled out. The fiber-removing roll thus becomes heavier and is more expensive to make. Furthermore, the roll becomes unusable and would have to be repaired at considerable expense as soon as one of the threads is ruined.

SUMMARY OF THE INVENTION

It is the object of the instant invention to create a fiber-removing roll, on the surface of which the teeth are attached in a simple and reliable manner and can be replaced easily.

This object is attained through the invention by having the teeth provided with a contact surface adapted to the circumferential contour of the fiber-removing roll and are screwed into pegs.

In order to give the teeth a secure hold on the mantle surface, independently of manufacturing tolerances, the contact surface is reduced to two contact shoulders located at a distance from each other.

The pegs are, preferably, each provided with two shoulders, one of which is located outside and the other one inside the mantle of the fiber-removing roll. In this way, positive locking of the tooth is ensured on the one hand, and on the other hand the peg is prevented from falling through the perforation into the interior of the fiber-removing roll. Stable holding of the tooth in its position is achieved by the fact that the peg is seated with a rectangular cross-section in the receiving opening of the lug of the receiving surface. The teeth are preferably made in the form of double teeth.

BRIEF DESCRIPTION OF THE DRAWINGS

An embodiment of the invention is described through the drawings in which.

DETAILED DESCRIPTION OF THE DRAWINGS

Figure 1:
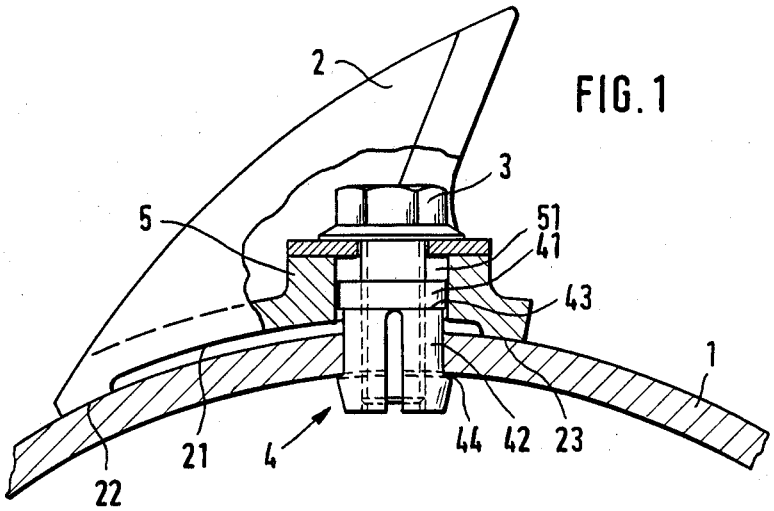
FIG. 1 is a cross-section of the tooth attachment on the roll mantle in accordance with the invention.

According to FIG. 1, a tooth 2 is attached to the mantle surface of a fiber-removing roll 1 by means of a screw 3 in a peg 4 which is inserted in a perforation in the wall of the fiber-removing roll 1. Tooth 2 is provided with a contact surface 21 which is adapted to the circumferential contour of the fiber-removing roll 1 and extends in the direction of the circumference over a section of the roll mantle. However, the contact of the tooth over its entire contact surface 21 occurs only when high precision methods are used in the manufacture of the fiber-removing roll. Since this is most often not the case, the contact is reduced to two contact shoulders 22 and 23 which are located at a distance from each other in the direction of the circumference, in the embodiment, given as an example, at the ends of the contact surface 21.

The peg comprises a rectangular part 41 and a round part 42. It is seated with the rectangular part 41 in an equally rectangular receiving opening 51 of the lug 5 of the contact surface 21, and with the round part 42 in a perforation in the mantle of the fiber-removing roll. At its rectangular part 41, as well as at its round part 42, the peg 4 is provided with shoulders 43 and 44. The shoulder 43, located outside the mantle of the fiber-removing roll 1, prevents the peg from falling into the interior of the fiber-removing roll when the screw 3 has been unscrewed. The bevelled shoulder 44 on the inside of the fiber-removing roll is pressed against the inner wall of the mantle when the screw 3 is tightened and constitutes positive locking of the tooth against the mantle of the roll. The insertion of the peg 4 in the perforation in the mantle of the roll and the extraction over shoulder 44 is made possible by a longitudinal expansion slit 45 in peg 4.

Figure 2:
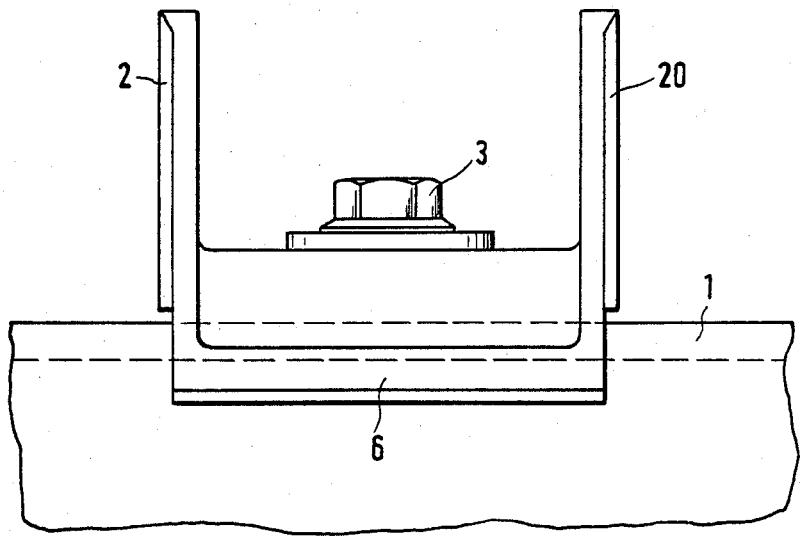
FIG. 2 is a side-view of a double tooth attached to the mantle of the roll.

The configuration of the contact surface, as described, and the removable installation is possible with single teeth as well as with double teeth 22 as shown in FIG. 2, which are connected to each other via a connector 6. In this case, a simple screw connection of the type according to invention is sufficient also for secure and stable attachment of double teeth.

What is claimed is:

1. A fiber-removing roll for a bale opener, comprising:

(a) a hollow cylinder having a mantle with a plurality of perforations in said mantle;

(b) anchoring pegs, disposed in a plurality of said perforations;

(c) a plurality of fiber-removing teeth, each of which has a base with an arcuate contact surface adapted to conform to the outer circumferential contour of said hollow cylinder mantle; and (d) means to anchor each of said teeth in place on circumferential contour and to said anchoring peg, whereby said teeth are releasably, but securely held on the circumferential contour of said hollow cylinder.

2. A fiber-removing roll as set forth in claim 1, wherein said contact surface is reduced to two contact shoulders spaced a distance from each other.

3. A fiber-removing roll as set forth in claim 1, wherein each of said pegs has two shoulders, one of which is located on the outside of said mantle and the other of which is located on the inside of said mantle of said fiber-removing roll.

4. A fiber-removing roll as set forth in claim 1, wherein each of said pegs has a portion with a non-circular cross-section mating with a non-circular opening in the base of said fiber-removing teeth.

5. A fiber-removing roll as set forth in claim 4, wherein said non-circular cross-section portion of said peg is rectangular.

6. A fiber-removing roll for a bale opener, comprising:

(a) a hollow cylinder having a cylindrical surface with a plurality of perforations therein;

(b) an anchoring peg disposed in each of a plurality of said perforations;

(c) a plurality of fiber-removing tooth pairs, each of which is connected with a base which has an arcuate contact surface adapted to conform to the outer cylindrical surface of said hollow cylinder; and (d) means to anchor each of said bases in place on said cylindrical surface, and to said anchoring peg, whereby said tooth pairs are releasably, but securely held on said cylindrical surface.

7. A fiber-removing roll as set forth in claim 6, wherein said contact surface is reduced to two contact shoulders spaced a distance from each other.

8. A fiber-removing roll as set forth in claim 6, wherein each of said pegs has two shoulders, one of which is located on the outside of said mantle and the other of which is located on the inside of said mantle of said fiber-removing roll.

9. A fiber-removing roll as set forth in claim 6, wherein each of said pegs has a portion with a non-circular cross-section mating with a non-circular opening in the base of said fiber-removing teeth.

10. A fiber-removing roll as set forth in claim 9, wherein said non-circular cross-section portion of said peg is rectangular.

* * * * *